US010254064B2

(12) United States Patent
Longueira

(10) Patent No.: US 10,254,064 B2
(45) Date of Patent: Apr. 9, 2019

(54) FIREARM FRAME LUG

(71) Applicant: Dino C. Longueira, Staten Island, NY (US)

(72) Inventor: Dino C. Longueira, Staten Island, NY (US)

( * ) Notice: Subject to any disclaimer, the term of this patent is extended or adjusted under 35 U.S.C. 154(b) by 0 days.

(21) Appl. No.: 15/805,651

(22) Filed: Nov. 7, 2017

(65) Prior Publication Data

US 2018/0135928 A1 May 17, 2018

Related U.S. Application Data

(60) Provisional application No. 62/421,690, filed on Nov. 14, 2016.

(51) Int. Cl.

| | |
|---|---|
| ***F41A 11/00*** | (2006.01) |
| ***F41A 3/66*** | (2006.01) |
| ***F41A 11/04*** | (2006.01) |
| ***F41A 21/48*** | (2006.01) |
| ***F41C 7/11*** | (2006.01) |

(52) U.S. Cl.

CPC ..... *F41A 11/00* (2013.01); *F41A 3/66* (2013.01); *F41A 11/04* (2013.01); *F41A 21/488* (2013.01); *F41C 7/11* (2013.01)

(58) Field of Classification Search

CPC .. F41A 3/66; F41A 11/00; F41A 11/04; F41A 21/488

USPC ..... 42/7, 40, 44

See application file for complete search history.

(56) References Cited

U.S. PATENT DOCUMENTS

| | | | | |
|---|---|---|---|---|
| 1,370,118 | A * | 3/1921 | Johnson | F41A 21/484 24/2.5 |
| 4,288,938 | A * | 9/1981 | Kahn | F41A 21/488 42/59 |
| 4,446,771 | A * | 5/1984 | Anthony | F41A 13/00 102/522 |
| 4,638,716 | A * | 1/1987 | Goff | F41A 11/00 42/75.03 |
| 9,791,223 | B2 | 10/2017 | Anderson et al. | |
| 2012/0180360 | A1* | 7/2012 | Jones | F41A 11/02 42/75.03 |
| 2012/0204465 | A1* | 8/2012 | Hasler | F41A 3/64 42/75.03 |
| 2014/0075802 | A1* | 3/2014 | Dubois | F41A 11/00 42/16 |

(Continued)

*Primary Examiner* — Bret Hayes

(74) *Attorney, Agent, or Firm* — Ostrager Chong Flaherty & Broitman PC

(57) ABSTRACT

A frame lug for a firearm having a receiver or barrel hingedly mounted to a frame is provided with a tension post having an external thread that adjustably engages with an internal thread of a vertical bore in the frame lug. The tension post provides a height adjustable top surface upon which the receiver or barrel rests when in a closed position and maintains a tight metal-to-metal connection to improve precision of fitting together the receiver or barrel and the frame. Firearms may have the frame lug installed therein or be retro-fitted with the frame lug. In a retro-fitting method, the firearm's frame lug is removed, a threaded vertical bore is machined at least partially into the frame lug, and an externally threaded tension post is adjustably engaged with the vertical bore such that a top surface of the tension post provides a tight fit with the receiver or barrel.

20 Claims, 6 Drawing Sheets

(56) References Cited

U.S. PATENT DOCUMENTS

| | | | | |
|---|---|---|---|---|
| 2015/0059221 | A1* | 3/2015 | Bero | F41A 3/66 42/16 |
| 2016/0187087 | A1* | 6/2016 | Olsen | F41A 3/66 42/75.03 |
| 2017/0299292 | A1* | 10/2017 | Daley, Jr. | F41A 11/00 |

* cited by examiner

FIREARM FRAME LUG

TECHNICAL FIELD

This disclosure relates generally to firearms and, more particularly, to firearms of the type employing a hinged assembly and dismantling system.

BACKGROUND

Hinged assembly and dismantling systems for firearms are usually only found on break-open shotguns and rifles, and not on smaller types of firearms, such as pistols. The usual manufacturing technique for production of a firearm that employs a hinged assembly and dismantling system requires the use of components which must be produced extremely precisely. This also necessitates the use of hand fitting. Both techniques are costly and difficult to produce. Hinged assembly and dismantling systems also have inherent problems when employed in mass-produced firearms of any type. The problem is the ability to fit all the components together with a level of precision that would allow for smooth and easy operation, while at the same time enabling a tight and solid lockup free of any play or motion between the components.

Firearm manufacturers are beginning to employ hinged assembly and dismantling systems in smaller firearms, such as the Ruger MK-IV .22 caliber pistol manufactured by Sturm, Ruger & Co., Inc. ("Ruger"). The hinged assembly and dismantling system utilized in the Ruger MK-IV pistol is described in U.S. Pat. No. 9,791,223 ("the '223 patent"), the disclosure of which is incorporated herein by reference thereto. FIGS. 1-4 herein are illustrations of a firearm 10 showing the hinge assembly and dismantling system. FIG. 1 shows the firearm 10 in an open or removal position of an assembled state with a receiver 12 having a mid-portion 14 that is operatively connected to a forward portion 16 of a frame 18 by a hinge 20, which permits the mid-portion 14 of the receiver 12 to rotate about the hinge 20 relative to the frame 18 such that the receiver 12 can be rotated from a closed or operational position where a rear portion 22 of the receiver 12 is substantially parallel to and connects with the frame 18 to the removal position (or open position) where the rear portion 22 of the receiver is separated from the frame 18, as shown in FIG. 1, to permit removal of the receiver 12 from the frame. FIG. 2 shows the firearm 10 with the receiver 12 dismantled or removed from the frame 18.

Referring to FIGS. 3-4, to minimize play and motion between the receiver 12 and the frame 18, a cylindrical rubber plug 24 is installed in a lug hole 26 in the top of a component known as the frame lug 28, which is removably mounted in a recess or channel 30 in the frame 18 at the forward portion 16 of the frame 18 such that it forms a part of the hinge 20. Upon hinging the receiver 12 and the frame 18 and moving the receiver 12 into the closed or operational position, the rubber plug 24 is compressed by a bottom surface of the receiver 12 against the frame lug 28 to provide a snug fit between the receiver 12 and the frame 18. The frame lug 28 and rubber plug 24 are shown and described in the '223 patent, respectively, as elements 450 (separate frame pivot insert) and 340 (resiliently compressible rubber or elastomeric bumper) at column 21, lines 62 to column 23, line 31 and FIGS. 46, 47 and 51-55.

However, when using a rubber plug 24 of the type disclosed in the '223 patent, there remains undesirable play or motion between the receiver 12 and the frame 18. The rubber plug 24 will also deteriorate through normal wear and the play or motion between the receiver 12 and frame 18 will become greater over time. The rubber plug 24 will also not provide a consistent level of pressure to achieve a snug fit between the receiver 12 and frame 18, which will allow for additional play or motion between these components. Once the play or motion between the receiver 12 and frame 18 becomes greater, the wear on these components will be accelerated, necessitating repair or replacement. This arrangement is not conducive to a firearm which is expected to provide a long service life.

SUMMARY

The present disclosure is directed to a simple, low-cost device and methods for extending the useful service life and reducing the maintenance costs for firearms of the type having a hinged assembly and dismantling system, which may be in the form of a pistol according to non-limiting embodiments of the present disclosure. The device and method improve the precision of fitting firearm components together (namely, the frame and receiver or barrel) to provide a tight and solid lockup free of play or motion between components, and to compensate for both manufacturing variations and tolerances, as well as normal wear of the components. The device is designed to be retrofitted or installed in such a firearm with no modifications to the firearm's frame or receiver or barrel, or any other components of the existing firearm, thereby avoiding complex and costly machining or replacement of parts.

One aspect of the disclosure is a frame lug for a firearm having a receiver hingedly mounted to a frame. The frame lug is a component that may form part of the hinge connection between the frame and receiver, or barrel, and provides a surface upon which the receiver or barrel rests when in an operational or closed position. The frame lug has a main body defining an upwardly open receptacle having a bottom surface. A vertical bore having a threaded internal surface extends through the bottom surface and at least partially into the main body. A tension post having a threaded external surface is adjustably engaged with the threaded internal surface of the vertical bore to permit a height of a top surface of the tension post above the bottom surface to be adjusted. The tension post is made from a metal material to provide a solid metal-to-metal tight fit between the tension post and the receiver when the receiver is in an operational position on the frame, which reduces wear and tear on the components. The adjustability feature of the tension post provides a tight fit that prevents play or motion between the components, and compensates for both manufacturing variations and tolerances, as well as normal wear of the components.

A horizontal bore having a second threaded internal surface may be machined through a side surface of the main body and extended to the vertical bore such that the horizontal bore and the vertical bore are operatively connected. A lock screw having a second threaded external surface is adjustably engaged with the second threaded internal surface of the horizontal bore for locking the tension post in place, preventing movement of the tension post, when the lock screw contacts the tension post through the operative connection of the vertical bore and the horizontal bore.

Another aspect of the disclosure is a firearm having a receiver hingedly mounted to a frame and a frame lug in accordance with the first aspect of the disclosure.

A further aspect of the disclosure is a retrofitting kit for a firearm having a receiver or barrel hingedly mounted to a frame and a frame lug. The kit comprises a frame lug in accordance with the first aspect of the disclosure and one or more fastening devices. The fastening devices engage receptacles in a top surface of the tension post and in an end surface of the lock screw to permit rotation and movement of the tension post and the locking screw into and out of the vertical bore and horizontal bore, respectively.

In yet another aspect of the disclosure, a method is provided for retrofitting a firearm comprising a receiver hingedly mounted to a frame and a frame lug having a main body defining an upwardly open receptacle having a bottom surface. The first step of the method is removing the frame lug from the frame. Then, a threaded internal surface is machined into a vertical bore extending through the bottom surface and at least partially into the main body. A tension post is fabricated having a threaded external surface and adjustably engaged with the threaded internal surface of the vertical bore such that a height of a top surface of the tension post above the bottom surface is adjustable. The height should be adjusted such that the top surface of the tension post will contact a lower surface of the receiver when the receiver is in an operational position on the frame. The frame lug can then be re-inserted into the frame.

In a further aspect of the method, a horizontal bore having a second threaded internal surface is machined through a side surface of the main body to extend to the vertical bore such that the horizontal bore and the vertical bore are operatively connected. A lock screw is fabricated having a second threaded external surface and adjustably engaged with the second threaded internal surface of the horizontal bore. The lock screw can be adjusted to engage and prevent movement of the tension post, locking the height of the tension post at the desired height. Then, the frame lug can be re-inserted into the frame.

Other objects, features, functions and advantages of the present disclosure will be apparent when the disclosure is considered in conjunction with the drawings annexed hereto, which should be construed in an illustrative and not limiting sense.

BRIEF DESCRIPTION OF THE DRAWINGS

The features of the exemplary embodiments will be described with reference to the following drawings, where like elements are labeled similarly, and in which.

DETAILED DESCRIPTION

Figure 1:
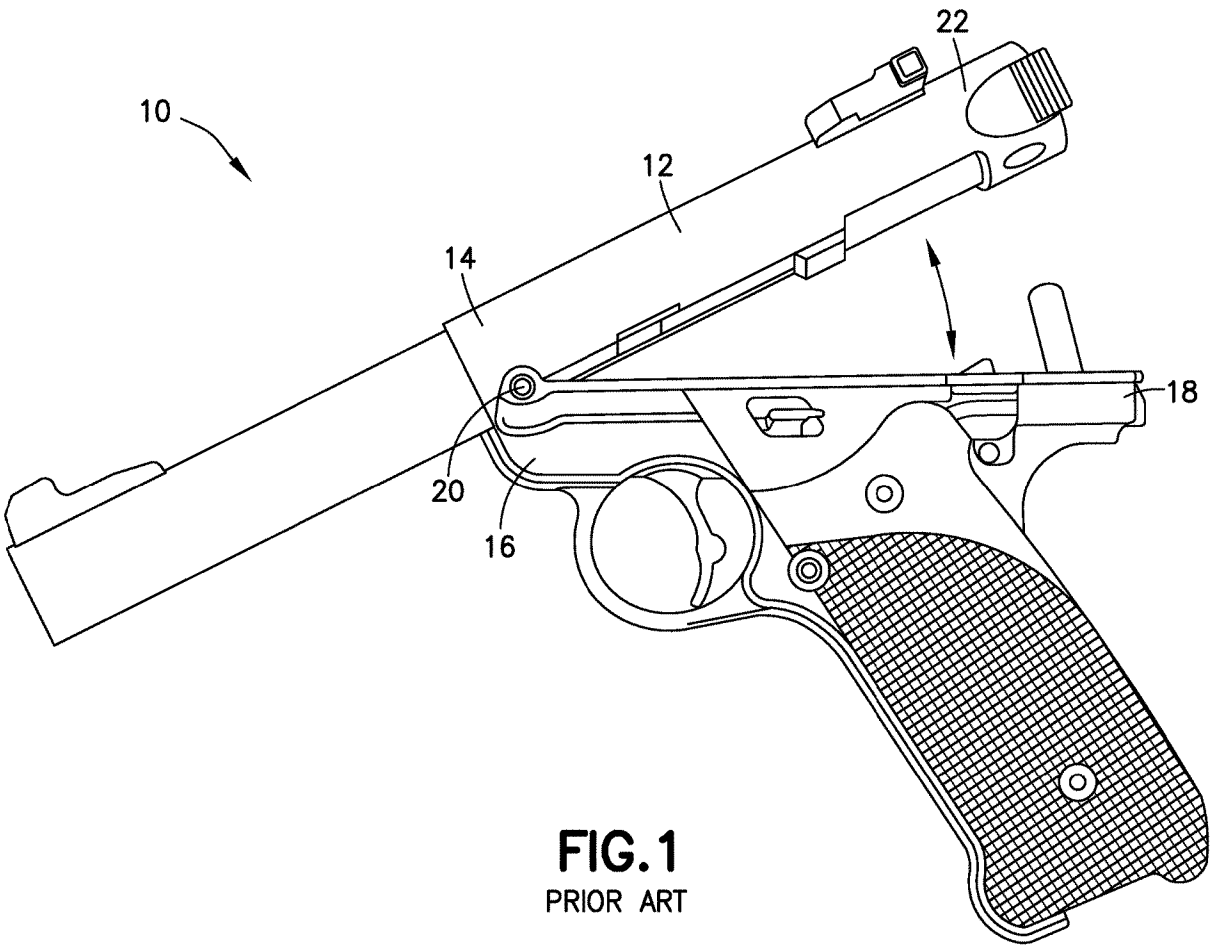
FIG. 1 PRIOR ART
FIG. 1 is an illustration of a firearm having a hinged assembly and dismantling system in an open or removal position of an assembled state.
Figure 2:
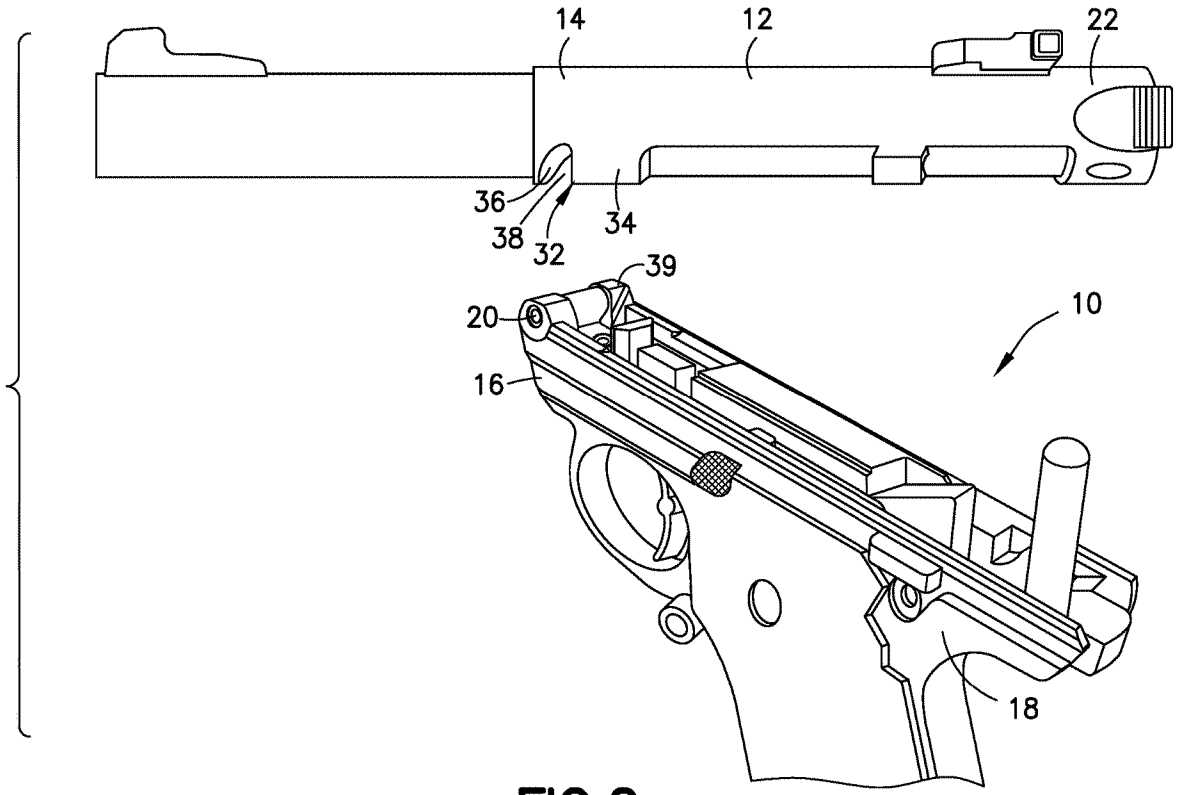
FIG.2 PRIOR ART
FIG. 2 is an illustration of the firearm shown in FIG. 1 in a dismantled or disassembled state.
Figure 3:
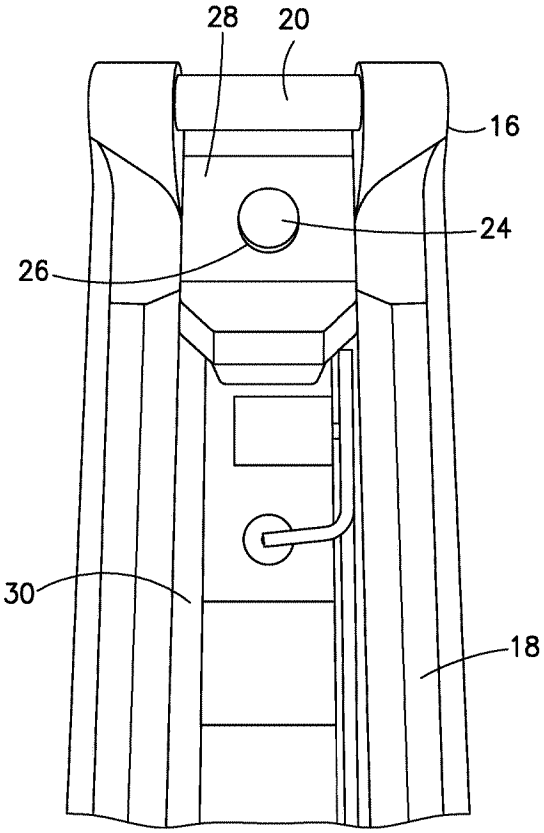
FIG.3 PRIOR ART
FIG. 3 is a top plan view of a forward portion of a frame of the firearm shown in FIG. 2 in a dismantled or disassembled state.

The disclosure of an exemplary embodiment is directed to a firearm employing a hinged assembly and dismantling system in the form of a pistol as shown, for example, in FIGS. 1-3. However, the broad concepts disclosed are applicable to shotguns, rifles and other types of firearms that employ a hinged assembly and dismantling system including a receiver or a barrel hingedly mounted to a frame and a frame lug.

Figure 5:
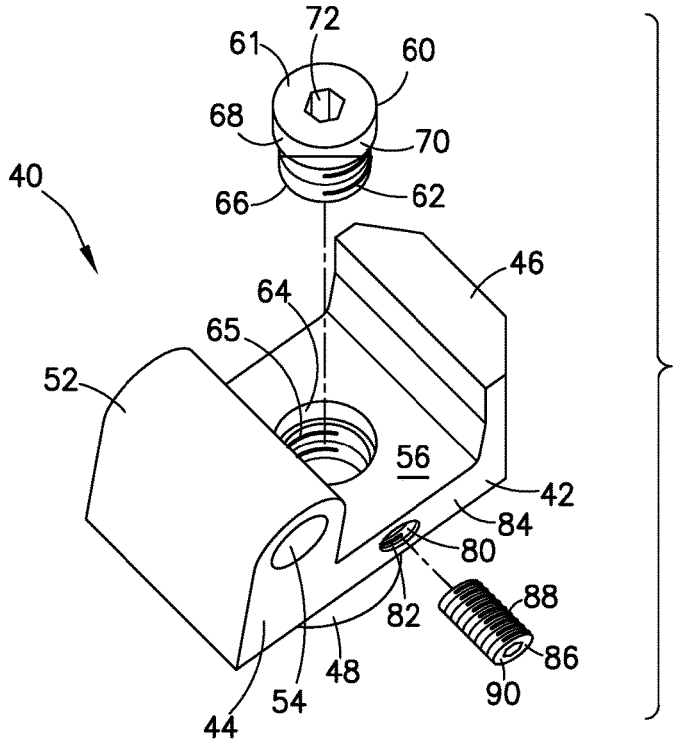
FIG. 5 is a perspective view of a modified frame lug and tension post for use with the firearm shown in FIGS. 1-3.
Figure 6:
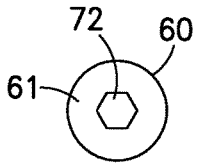
FIG. 6 is a top plan view of a tension post employed in the modified frame lug shown in FIG. 5.
Figure 7:
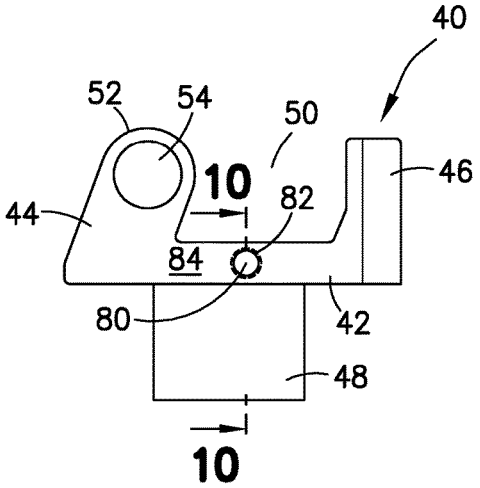
FIG. 7 is an elevation view of a side of the modified frame lug shown in FIG. 5.

FIGS. 5-7 illustrate a modified frame lug 40 that provides a consistent tight fit between the receiver 12 and the frame 18 in a firearm 10 when the receiver 12 is in an operational position. The modified frame lug 40 may be made of any metallic material suitable for use in firearms. The modified frame lug 40 generally comprises a main body 42, a front pivot protuberance 44 extending upwards from the main body 42, and a rear portion 46 extending upwards from the main body 42 and longitudinally spaced apart from the front pivot protuberance 44. A mounting stem 48 extends downwards from the main body 42 for mounting the modified frame lug 40 in the frame 18. The space between the front pivot protuberance 44 and rear portion 46 defines an upwardly open receptacle 50 (see FIG. 7) having a complementary configuration to a downwardly extending mounting protrusion 34 of the receiver 12 on which a hooked lug 32 is formed (see FIG. 2). The shape, size and configuration of the main body 42, the front pivot protuberance 44, the rear portion 46 and the mounting stem 48 may be modified from what is shown in FIG. 5 to accommodate other types of firearms with frames and receivers having different shapes, sizes and configurations.

In the example described herein, the front pivot protuberance 44 of the modified frame lug 40 may have a generally barrel-shape with a convexly curved configuration which defines a transversely elongated arcuate pivot surface 52 that engages a complementary concavely curved closed top end 36 of the receiver 12 assembly mounting slot 38 (see FIG. 2). The mutually engaged curved surfaces of the mounting slot 38 and the front pivot protuberance 44 provide smooth tilting action of the receiver 12 on the frame 18.

Figure 9:
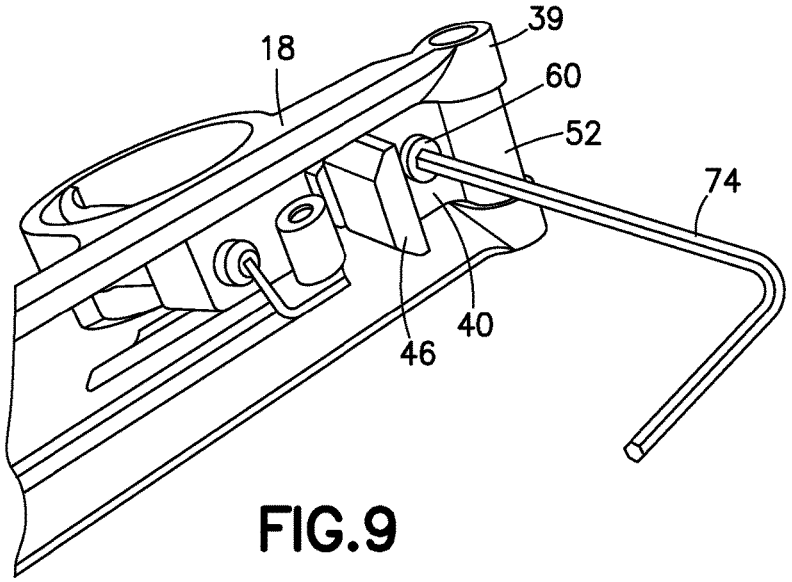
FIG. 9 is a perspective view of the forward portion of the frame of a firearm with the modified frame lug shown in FIG. 5 installed therein.

To mount the modified frame lug 40, the mounting stem 48 is inserted into an upwardly open hole in frame 18. The front pivot protuberance 44 includes a laterally open through hole 54 that is concentrically aligned with holes in the frame mounting protrusions 39 (see FIGS. 2 and 9). A lock pin is removably inserted through holes in the frame mounting protrusions 39 and the laterally open through hole 54 in the front pivot protuberance 44 to complete securement of the modified frame lug 40 in the frame 18. In this example, hooked lug 32 of the receiver 12 engages the front pivot protuberance 44, and not the lock pin which only serves to retain the modified frame lug 40 in frame 18. In alternative embodiments, the hooked lug 32 of the receiver 12 engages the lock pin directly and the modified frame lug 40 has a front pivot protuberance 44 that is smaller in size and a different shape to not interfere with the pivoting movement, or the front pivot protuberance 44 is removed from the modified frame lug 40.

The space between the front pivot protuberance 44 and rear portion 46 defines an upwardly open receptacle 50 (see FIG. 7) with a bottom surface 56 defined by the main body 42, the receptacle 50 having a complementary configuration to a downwardly extending mounting protrusion 34 of the receiver 12 on which a hooked lug 32 is formed (see FIG. 2).

Figure 4:
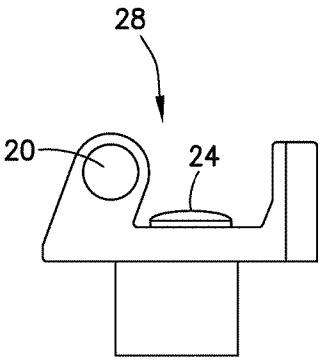
FIG.4 PRIOR ART
FIG. 4 is an elevation view of a side of a frame lug employed in the firearm shown in FIGS. 1-3.

Referring to FIGS. 3 and 4, in an existing frame lug 28, a resiliently compressible elastomeric rubber plug 24 may be provided to produce a snug or tight connection between the hooked lug 32 of the receiver 12 and the frame 18 when the receiver 12 is in the closed operational position. However, as described in the Background, such a rubber plug 24 has drawbacks.

Figure 8:
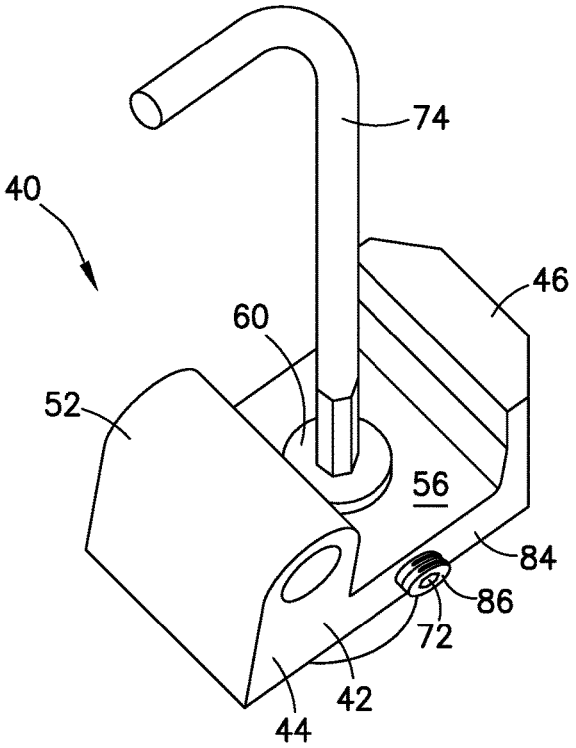
FIG. 8 is a perspective view of the improved frame lug shown in FIG. 5 with a tension post and a set screw positioned for installation therein.

Referring again to FIGS. 5-7, the modified frame lug 40 includes a tension post 60 having a threaded external surface 62 made from a metallic material suitable for use in firearms, such as steel, bronze or any other metallic material that can be used as a pressurized bearing point. The threaded external surface 62 of the tension post 60 is adjustably engaged with a vertical bore 64 having a threaded internal surface 66 that extends through the bottom surface 56 of the upwardly open receptacle 50 defined by the main body 42 and at least partially into the main body 42, which permits a height of a top surface 61 of the tension post 60 to be adjusted above the bottom surface 56 of the receptacle 50 by screwing the tension post 60 into and out of the vertical bore 64. The top surface 61 is flat and includes a slot or other type of receptacle 72 having dimensions suitable for coupling with a distal end of a fastening device 74, such as an Allen key, screw driver or other suitable fastening device, to permit a user to rotate the tension post 60 to facilitate movement of the tension post 60 into and out of the vertical bore 64 (see FIGS. 8 and 9). The threaded external surface 62 of the tension post 60 is matched with the threaded internal surface 66 of the vertical bore, for example both having 12-28 unified national fine (UNF) threads. The size and configuration of the threads is selected to have the maximum diameter that fits within the vertical bore 64, which has a size dependent on the size of the modified frame lug 40, which is variable depending on the type and size of firearm in which the frame lug 40 will be installed.

When the modified frame lug 40 is installed in the frame 18 and the receiver 12 (or barrel) is pivoted from an open position (shown in FIG. 1) to the closed operational position, the hooked lug 32 of the receiver 12 (or barrel) presses downwards against the top surface 61 of the tension post 60, which maintains a snug and tight metal-to-metal connection when the barrel-receiver assembly is closed and latched. This metal-to-metal connection improves the precision of fitting the receiver 12 (or barrel) and frame 18 together to provide a tight and solid lockup free of play or motion between the components, reducing maintenance costs and extending the useful service life of the firearm.

Figure 10:
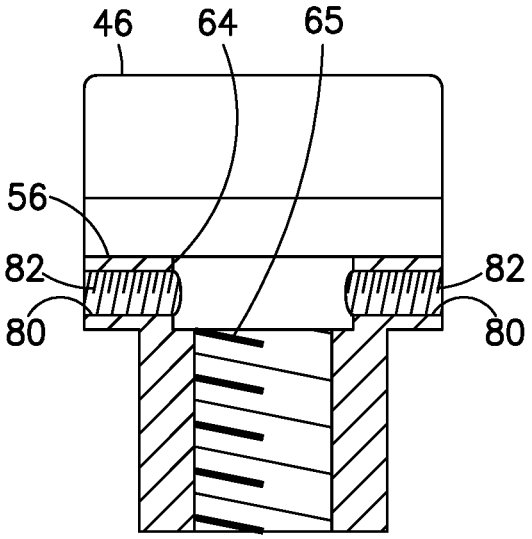
FIG. 10 is a cross-sectional view of the frame lug taken along the line 10-10 in FIG. 7.

An additional feature of the modified frame lug 40 is a locking mechanism for locking the tension post 60 in position to prevent any shift in the adjustment and ensure that a solid metal-to-metal fit between the receiver 12 (or barrel) and frame 18 is maintained. The locking mechanism includes a horizontal bore 80 having a second threaded internal surface 82 extending through at least one side surface 84 of the main body 42 and continuing through the main body 42 to the vertical bore 64 such that the horizontal bore 80 and the vertical bore 42 intersect and are operatively connected, as shown for example in FIG. 10. A horizontal bore 80 on only one side surface 84 of the main body 42 will lock the tension post 60 in position; however, two or more horizontal bores 80 may be used. The horizontal bore 80 may have a diameter, for example, of about 0.096 inch (+/− ten thousandths of an inch) to allow for the cutting of threads (for example, 4×40) on the second threaded internal surface 82. The size and configuration of the threads in the second threaded internal surface 82 is selected to have the maximum diameter that fits within the horizontal bore 80, which has a size dependent on the size of the modified frame lug 40, which is variable depending on the type and size of firearm in which the frame lug 40 will be installed.

A small threaded lock screw 86 having a second threaded external surface 88 that matches the second threaded internal surface 82 is adjustably engaged with the second threaded internal surface 82 of the horizontal bore 80, and when tightened or screwed into the horizontal bore 80, a distal end of the lock screw 86 will bear upon the tension post 60 in the vertical bore 64, locking the tension post 60 in place and preventing movement and any shift in the adjustment of the tension post 60 in the vertical bore 64. The threaded external surface 62 of the tension post 60 is positioned on at least a lower portion 66 of the tension post 60. To prevent damage to the threaded external surface 62 of the tension post, an upper portion 68 of the tension post 60 may have a non-threaded external surface 70, and the horizontal bore 80 is configured such that the lock screw 86 will bear upon the non-threaded external surface 70 of the tension post 60. An end surface 90 of the lock screw 86 includes a slot or other type of receptacle 72 having dimensions suitable for coupling with a distal end of a fastening device 74, such as an Allen key, screw driver or other suitable fastening device, to permit a user to rotate and facilitate movement of the lock screw 86 into and out of the horizontal bore 80.

The modified frame lug 40 may be made from the original parts incorporated in the firearm 10 by the firearm manufacturer (for example, by modifying the frame lug 28 in FIGS. 1-3 as described above). Alternatively, the modified frame lug 40 may be manufactured as a replacement component, or a firearm may be manufactured with a modified frame lug 40 as an original part of the firearm.

A method for retrofitting a firearm 10 comprising a receiver 12 hingedly mounted to a frame 18 with a modified frame lug 40 as described above is also disclosed. The first step of the method is to remove the original frame lug 28 from the frame 18 and remove the rubber plug 24 from the frame lug 28.

The next steps of the method are used when the modified frame lug 40 is made from the original parts incorporated in the firearm 10 by the firearm manufacturer or are used to manufacture a replacement or new modified frame lug 40. A threaded internal surface 65 is machined into a vertical bore 64 that extends through the bottom surface 56 of the upwardly open receptacle 50 defined by the main body 42 of the original frame lug 28 and at least partially into the main body 42. For example, a hole is drilled through the bottom surface 56 having a diameter of about 0.177 inch (+/− ten thousandths of an inch) to allow for the cutting of threads (12×28 tpi) to form the threaded internal surface 65 of the vertical bore 64. A similarly threaded tension post 60 is fabricated from a metallic material suitable for use in firearms with a threaded external surface 62 and a top surface 61 having a receptacle dimensioned for receiving a distal end of a fastening device, such as an Allen key, to permit rotation of the tension post 60. The threaded external surface 62 of the tension post 60 is adjustably engaged with the threaded internal surface 65 of the vertical bore 64 such that a height of the top surface 61 of the tension post 60 above the bottom surface 56 is adjustable. A horizontal bore 80 having a second threaded internal surface 82 is optionally machined through a side surface 84 of the main body 42 to the vertical bore 64 such that the horizontal bore 80 and the vertical bore 64 are operatively connected. A lock screw 86 is fabricated having a second threaded external surface 88 and adjustably engaged with the second threaded internal surface 82 of the horizontal bore 80.

Then, the modified frame lug 40 (whether made from the original parts incorporated in the firearm 10 by the firearm manufacturer or as a replacement component) is installed back into the frame 18 of the firearm 10 (see FIG. 9) with the lock screw 86 intentionally left loose or not installed. The tension post 60 is easily adjusted either up or down by rotating the tension post 60 with a fastening device 74 until a sold and tight fit between the receiver 12 and frame 18 has been achieved. The modified frame lug 40 may then be removed from the frame 18 and the lock screw 86 may be tightened by rotating the lock screw 86 with a fastening device 74 until the lock screw 86 engages the tension post 60 to lock and maintain the tension post 60 in the correct adjustment. The modified frame lug 40 is then reinstalled into the firearm 10 to provide a metal-to-metal contact between the tension post 60 and the receiver 12 (or barrel) when the receiver 12 (or barrel) is in an operational position on the frame 18.

The tension post 60 can be adjusted at any time as described above to achieve a solid metal-to-metal contact between the receiver 12 (or barrel) and frame 18 and compensate for manufacturing variations and tolerances, as well as normal wear which will occur over the course of time. The adjustability of the design produces a component with an indefinite life span.

Although the disclosure has been described with reference to preferred embodiments, which should be construed in an illustrative and not limiting sense, it will be appreciated by one of ordinary skill in the art that numerous modifications are possible in light of the above disclosure. For example, the modified frame lug 40, although designed based on a firearm in the form of a pistol, can be adapted to any firearm that employs a hinged assembly and dismantling system. The disclosed embodiment has been described in connection with retrofitting of a preexisting firearm. However, it will be apparent to those skilled in the art of gunsmithing that the disclosed modified frame lug 40 may be incorporated in new firearms as original features. Thus, the disclosure in its broadest scope encompasses any firearm having a hinged assembly and dismantling system and a frame lug, whether originally or by retrofitting, and the size, shape and configuration of the modified frame lug 40 may be adjusted for use in any such firearm. Other variations and modifications of the disclosure will be readily apparent to persons skilled in the art. All such variations and modifications are intended to be within the scope and spirit of the invention.

I claim:

1. A frame lug for a firearm having a receiver or barrel hingedly mounted to a frame, the frame lug comprising:

a main body defining a bottom surface of an upwardly open receptacle between a front pivot protuberance and a rear portion of the frame lug that both extend upward from the main body, the bottom surface providing a surface in the frame upon which the receiver or barrel rests when in an operational or closed position;

a vertical bore having a threaded internal surface extending through the bottom surface of the upwardly open receptacle and at least partially into the main body; and a tension post having a threaded external surface adjustably engaged with the threaded internal surface of the vertical bore such that a height of a top surface of the tension post above the bottom surface of the upwardly open receptacle is adjustable to maintain a snug and tight fit between the receiver or barrel and the frame when in the operational or closed position.

2. The frame lug of claim 1, wherein the tension post comprises a metal material to provide a metal-to-metal contact between the tension post and the receiver when the receiver is in the operational or closed position on the frame.

3. The frame lug of claim 2, wherein the top surface of the tension post comprises a receptacle for a fastening device to permit rotation of the tension post.

4. The frame lug of claim 1, wherein the threaded external surface of the tension post is positioned on a lower portion of the tension post, and an upper portion of the tension post has a non-threaded external surface.

5. The frame lug of claim 4, further comprising: a horizontal bore having a second threaded internal surface extending through a side surface of the main body and to the vertical bore in the bottom surface of the upwardly open receptacle such that the horizontal bore and the vertical bore are operatively connected, and a lock screw having a second threaded external surface adjustably engaged with the second threaded internal surface of the horizontal bore.

6. The frame lug of claim 5, wherein the lock screw, when screwed into the horizontal bore, engages the upper portion of the tension post in the vertical bore to prevent movement of the tension post.

7. The frame lug of claim 6, wherein the top surface of the tension post and an end surface of the locking screw each comprise a receptacle for a fastening device to permit rotation of the tension post and the locking screw.

8. A firearm comprising:

a frame having an upwardly open longitudinal recess;

a receiver or barrel hingedly mounted to the frame; and a frame lug removably mounted in the recess of the frame, the frame lug comprising: a main body defining a bottom surface of an upwardly open receptacle between a front pivot protuberance and a rear portion of the frame lug that both extend upward from the main body, the bottom surface providing a surface in the frame upon which the receiver or barrel rests when in an operational or closed position, a vertical bore having a threaded internal surface extending through the bottom surface of the upwardly open receptacle and at least partially into the main body, and a tension post having a threaded external surface adjustably engaged with the threaded internal surface of the vertical bore such that a height of a top surface of the tension post above the bottom surface of the upwardly open receptacle is adjustable to maintain a snug and tight fit between the receiver or barrel and the frame when in the operational or closed position.

9. The firearm of claim 8, wherein the tension post comprises a metal material to provide a metal-to-metal contact between the tension post and the receiver when the receiver is in the operational or closed position on the frame.

10. The firearm of claim 9, wherein the top surface of the tension post comprises a receptacle for a fastening device to permit rotation of the tension post.

11. The firearm of claim 8, wherein the threaded external surface of the tension post is positioned on a lower portion of the tension post, and an upper portion of the tension post has a non-threaded external surface.

12. The firearm of claim 11, further comprising: a horizontal bore having a second threaded internal surface extending through a side surface of the main body and to the vertical bore in the bottom surface of the upwardly open receptacle such that the horizontal bore and the vertical bore are operatively connected, and a lock screw having a second threaded external surface adjustably engaged with the second threaded internal surface of the horizontal bore.

13. The firearm of claim 12, wherein the lock screw, when screwed into the horizontal bore, engages the upper portion of the tension post in the vertical bore to prevent movement of the tension post.

14. The firearm of claim 13, wherein the top surface of the tension post and an end surface of the locking screw each comprise a receptacle for a fastening device to permit rotation of the tension post and the locking screw.

15. A method for retrofitting a firearm comprising a receiver or barrel hingedly mounted to a frame and a frame lug having a main body defining a bottom surface of an upwardly open receptacle between a front pivot protuberance and a rear portion of the frame lug that both extend upward from the main body, the bottom surface providing a surface in the frame upon which the receiver or barrel rests when in an operational or closed position, the method comprising the steps of:

removing the frame lug from the frame;

machining a threaded internal surface into a vertical bore extending through the bottom surface of the upwardly open receptacle and at least partially into the main body;

adjustably engaging a threaded external surface of a tension post into the threaded internal surface of the vertical bore such that a height of a top surface of the tension post above the bottom surface of the upwardly open receptacle is adjustable;

inserting the frame lug into the frame; and adjusting the height of the top surface of the tension post to maintain a snug and tight fit between the receiver or barrel and the frame when in the operational or closed position.

16. The method of claim 15, wherein the tension post is fabricated from a metal material to provide a metal-to-metal contact between the tension post and the receiver when the receiver is in the operational or closed position on the frame.

17. The method of claim 15, wherein the tension post is fabricated with a threaded external surface on a lower portion of the tension post and a non-threaded external surface on an upper portion of the tension post.

18. The method of claim 17, further comprising the steps of: machining a horizontal bore having a second threaded internal surface through a side surface of the main body and to the vertical bore such that the horizontal bore and the vertical bore are operatively connected; fabricating a lock screw having a second threaded external surface; and adjustably engaging the second threaded external surface with the second threaded internal surface of the horizontal bore.

19. The method of claim 18, further comprising adjusting the lock screw to engage the upper portion of the tension post to prevent movement of the tension post.

20. The method of claim 19, further comprising machining a receptacle for a fastening device into each of the top surface of the tension post and an end surface of the locking screw to permit rotation of the tension post and the locking screw.

* * * * *